US006371629B1

(12) United States Patent
Martinez

(10) Patent No.: US 6,371,629 B1
(45) Date of Patent: Apr. 16, 2002

(54) DECORATIVE LIGHTS AND METHOD

(76) Inventor: John R. Martinez, 1951 Homeworth, Rancho Palos Verdes, CA (US) 90275

( * ) Notice: Subject to any disclaimer, the term of this patent is extended or adjusted under 35 U.S.C. 154(b) by 0 days.

(21) Appl. No.: 09/676,619

(22) Filed: Oct. 2, 2000

Related U.S. Application Data

(63) Continuation-in-part of application No. 09/385,477, filed on Aug. 30, 1999.
(60) Provisional application No. 60/104,055, filed on Oct. 13, 1998.

(51) Int. Cl.[7] ..... F21S 13/10
(52) U.S. Cl. ..... 362/363; 362/252; 362/248
(58) Field of Search ..... 362/362, 363, 362/252, 248, 806, 808, 809, 154, 191, 234, 361, 351, 184

(56) References Cited

U.S. PATENT DOCUMENTS

| | | | |
|---|---|---|---|
| 4,926,296 | A | 5/1990 | Blume et al. |
| 5,091,833 | A | 2/1992 | Paniaguas et al. |
| 5,359,506 | A | 10/1994 | Koleno |
| 5,442,177 | A | 8/1995 | Boulos et al. |
| 5,567,045 | A | 10/1996 | Bueck |
| 5,597,230 | A | 1/1997 | Newman |
| 6,022,241 | A | 2/2000 | Lin |

FOREIGN PATENT DOCUMENTS

| | | | |
|---|---|---|---|
| CH | 673517 | A5 | 12/1978 |

*Primary Examiner*—Sandra O'Shea
*Assistant Examiner*—Hargobind S. Sawhney
(74) *Attorney, Agent, or Firm*—John J. Connors; Connors & Associates

(57) ABSTRACT

Decorative lights includes a plurality lamps attached to a conductive line terminating in a plug member adapted to be connected to a source of electrical power. Each lamp comprises an enclosure with a light source therein. The enclosure has an opaque portion and a light transmitting portion, and the opaque and a light transmitting portions arranged to resemble an open eye. A mouthpiece member is adapted to be removably attached to the support member.

21 Claims, 16 Drawing Sheets

104a
104c
t
102a 102a
102
104
104b
102
100
110

106
10
102b
102b
110a
50
10
110
30
22
110a
112

DECORATIVE LIGHTS AND METHOD

RELATED PATENT APPLICATIONS

This application is a continuation-in-part application of U.S. patent application Ser. No. 09/385,477, entitled Decorative Lights & Method, filed Aug. 30, 1999, which is a utility patent application based on U.S. provisional application Serial No. 60/104,055, entitled "Midnight Eyes Lighting Strings," filed Oct. 13, 1998. These related applications are incorporated herein by reference and made a part of this application.

BACKGROUND OF THE INVENTION

It is common in the United States, and many other countries, to decorate both indoors and outdoors using strings of lights. During the Halloween season, however, strings of lights are not typically employed. Nevertheless, there are decorations of witches, ghosts, jack-o'-lanterns, etc. which sometimes are illuminated. The present invention provides a new form of decorative lights that would be particularly useful during the Halloween season, as will be understood from the following disclosure.

SUMMARY OF THE INVENTION

This invention has several features, no single one of which is solely responsible for its desirable attributes. Without limiting the scope of this invention as expressed by the claims that follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to, ease of manufacture and assembly, low cost, and provision for a new and entertaining string of decorative lights for Halloween.

The first feature of the decorative lights of this invention is that it includes a plurality of lamps, each lamp comprising an enclosure with a light source therein. Each enclosure has an opaque portion and a light transmitting portion arranged to resemble an individual facial feature that is illuminated. For example, the opaque portion and a light transmitting portion may be arranged to depict an open, illuminate eye. or an open, illuminated mouth with exposed teeth.

The second feature is that one or more pairs of the lamps are attached to a conductive line adapted to be connected to a source of electrical power. Each pair of lamps is connected to a rigid support member. The individual lamps of each pair of lamps on an individual support member are spaced apart a distance of from 0.1 to 8 inches. The lamps may be in a fixed position relative to each other or they may be mounted to move relative to each other to vary the distance between them. Optionally, there is switch member that turns at least some of the pairs of lamps on and off intermittently. This switch member may be a trigger bulb or a timer and relay circuit. There may also be a motion sensor connected to the decorative lights to turn said lights on in response to motion. When the decorative lights of this invention are connected directly to an AC power source, they preferably include a male plug at one end of the conductive line and a female connector at the other end of the conductive line. A DC power source may also be use. In such case, an adapter is employed to convert AC current to DC current or batteries are used. It may also be desirable to employ a transformer to reduced voltage from a high to a low voltage.

The third feature is that the support member may include a pair of detachable sockets. Each individual socket receives an individual light source, for example, a light bulb, light emitting diode (LED), or 2.5 to 3.5 volt mini Christmas tree lights. The support member has a pair of gripping members that are moveable between an open position to receive the sockets and a closed position where the sockets are held in position in the support member. Preferably, the support member has a hook element thereon.

The fourth feature is that each lamp comprises an enclosure with a light source therein. Preferably, enclosures are mounted to rotate and they are substantially watertight. By substantially watertight the inventor means that the enclosure resists leakage so that the light bulb and socket within the enclosure are not exposed water produced by normal rain and snow. This is achieved by having the components of the enclosure made of plastic materials and having them fit snugly together. Optionally, rubber seals may also be used. In alternate embodiments of this invention, this "watertight" feature is not required and a drain is provided. Each enclosure has an opaque portion and a light-transmitting portion. The opaque and light transmitting portions are arranged to resemble an open eye. Preferably, the opaque and light-transmitting portions arranged to resemble an open eye are formed by cutting away a section of the opaque portion. Preferably, different pairs of lamps have an opaque and light-transmitting portions arranged to resemble open eyes of different shapes.

The fifth feature is that the enclosure is substantially a spherical structure including a pair of substantially hemispherical shells mounted to be detachably connected together. One hemispherical shell has an open section in the form of an outline of an eye with a remainder section of the one shell being essentially entirely opaque. The other hemispherical shell is essentially entirely opaque and has a central opening therein at a base portion adjacent the support member. This central opening enables the light source to be inserted therein. The open sections in the form of an outline of an eye in the one hemispherical shell and the central opening in the other hemispherical shell are aligned.

The sixth feature is that a light transmitting element may be inserted into the one hemispherical shell. This light transmitting element has a hemispherical shape that is slightly smaller than the hemispherical shape of the one hemispherical shell. There may be a small opaque portion shaped like pupil of an eye attached to an exterior portion of the transmitting element. The seventh feature is that the support member has attached thereto a mouthpiece member. This mouth piece member comprises a rigid arm having a length of from about 2 to about 6 inches with a first end that is detachably connected to the support member. At a second end of the arm is connected a lamp, similar to the lamps discussed above. This lamp includes an enclosure, preferably water tight, with a light source therein, and it has an opaque portion and a light transmitting portion arranged to resemble an open mouth, preferably showing teeth. The enclosure may be opened to remove a burned out bulb, for example.

The eighth feature is that the lamps may emit light of different colors. This can be achieved by employing transmitting elements of different colors or using individual light sources that emit light of different colors.

The ninth feature is that one embodiment provides for an enclosure having a rear portion holding a single light source. There is a front portion having a pair of spaced apart members each with opaque and light transmitting portions arranged to resemble an open eye light, at least some of the light from the single light source escaping the enclosure through said light transmitting portions. Each eye member has a hollow interior having a reflective surface that is substantially flat. These reflective surfaces face inward towards each other. Preferably, there is a heat shield that at least partially encloses the single light source. A flashing light bulb is the preferred light source This invention also includes a methods of decorating. One method includes:

(a) providing decorative lights including
  a pair of spaced apart lamps attached to a conductive line adapted to be connected to a source of electrical power,
  each lamp comprising an enclosure with a light source therein, said enclosure having an opaque portion and a light transmitting portion,
  said opaque and light transmitting portions arranged to resemble an open eye, (b) hanging the decorative lights on an item to be decorated, and (c) attaching the line to a source of electrical power.

According to this method, the lamps are attached to a support member with a hook thereon that facilitates hanging the decorative lights.

Another method includes (a) providing a conductive line having decorative lights connected thereto, each light comprising
  an enclosure having a rear portion holding a single light source and a front portion,
  said front portion having a pair of spaced apart members each with opaque and light transmitting portions arranged to resemble an open eye light, at least some of the light from said single light source escaping the enclosure through said light transmitting portions, (b) hanging the decorative lights on an item to be decorated, and (c) attaching the line to a source of electrical power.

DESCRIPTION OF THE DRAWING

The preferred embodiments of this invention, illustrating all its features, will now be discussed in detail. This embodiment depicts the novel and non-obvious decorative and method of this invention as shown in the accompanying drawing, which is for illustrative purposes only. This drawing includes the following figures (FIGS.), with like numerals indicating like parts.

DETAILED DESCRIPTION OF THE PREFERRED EMBODIMENTS

Figure 1:
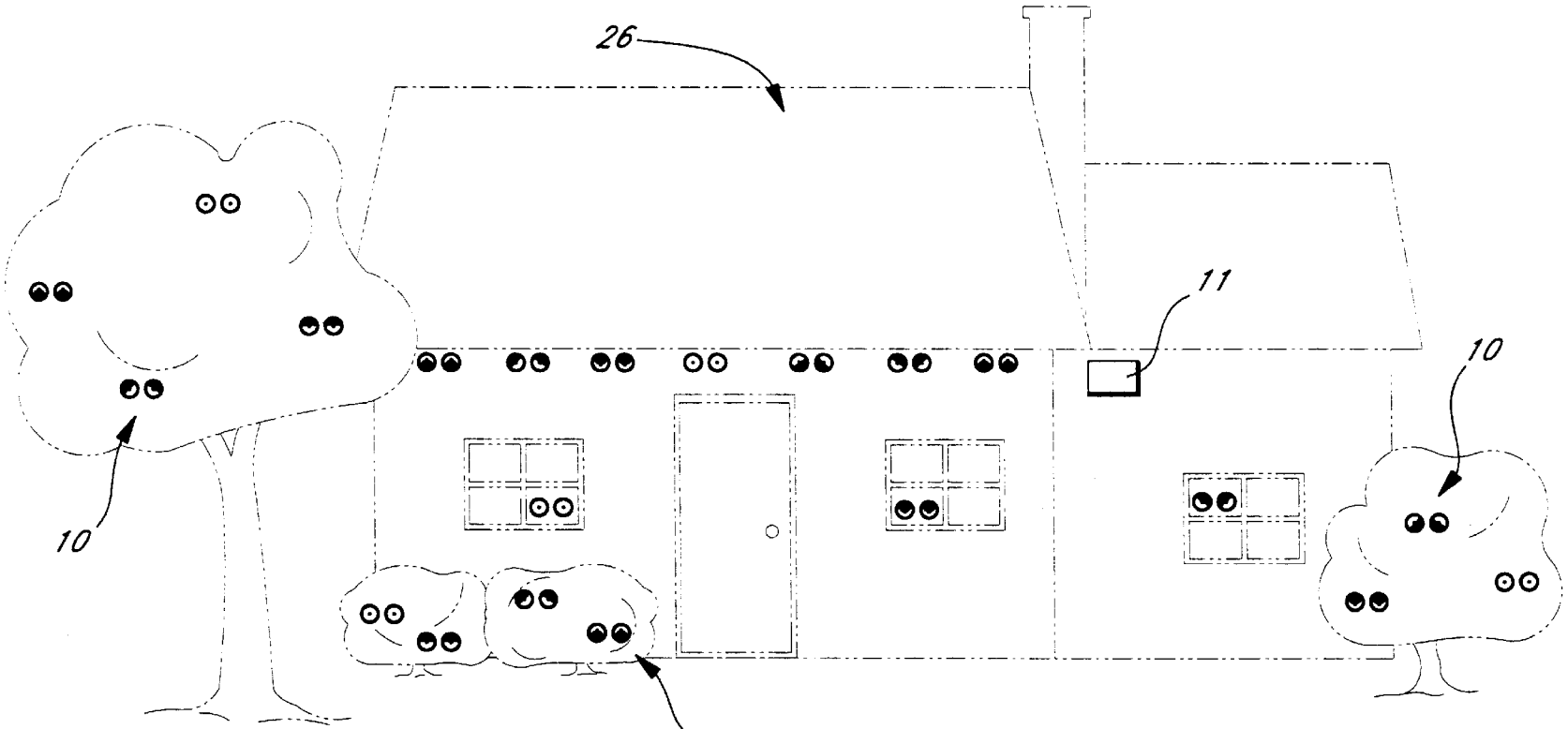
FIG. 1 is a front view depicting the exterior of a house decorated using the decorative lights of this invention.
Figure 2:
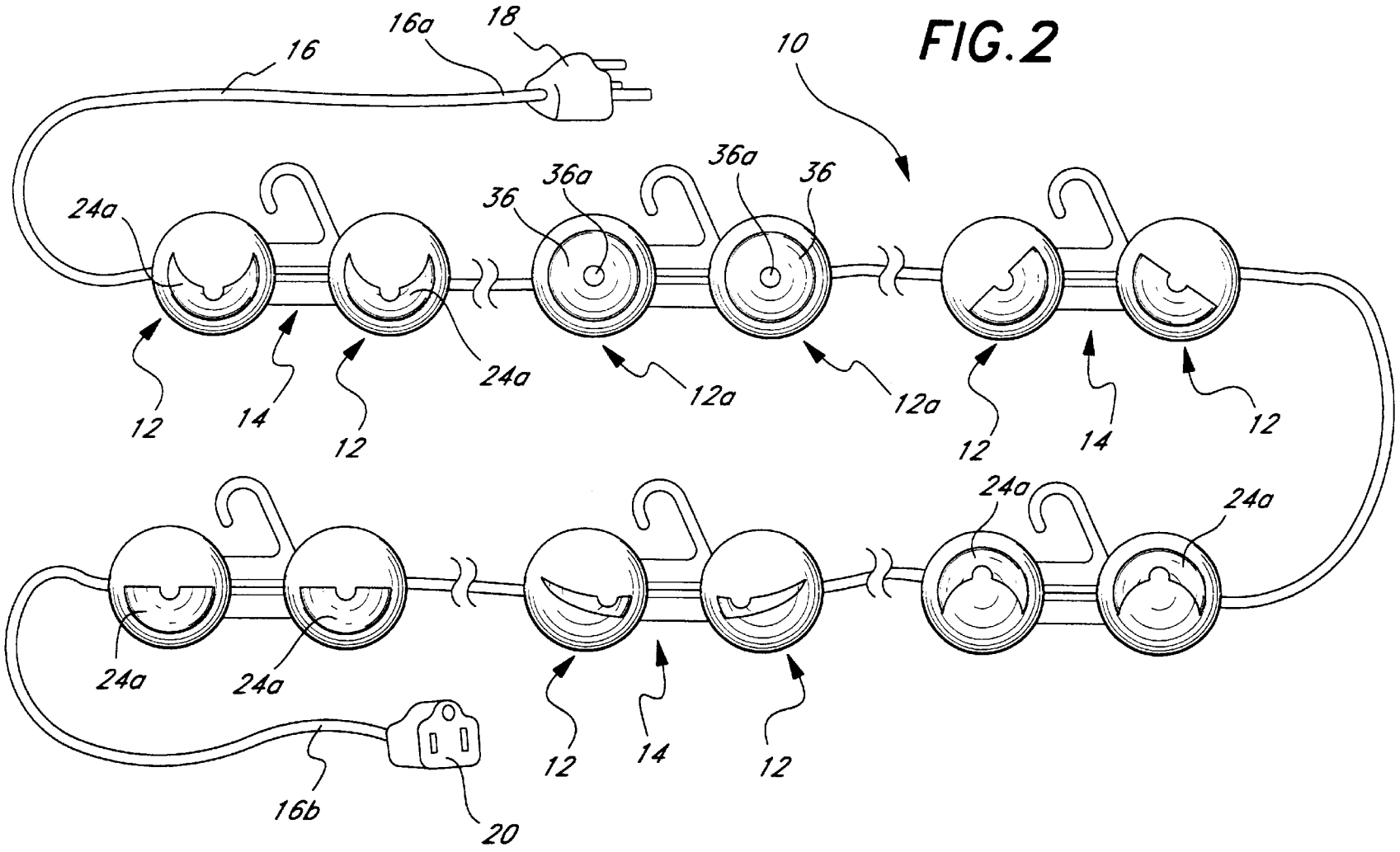
FIG. 2 is a perspective view showing a string of the decorative lights of this invention, which are adapted to be plugged into a conventional AC power source.
Figure 3:
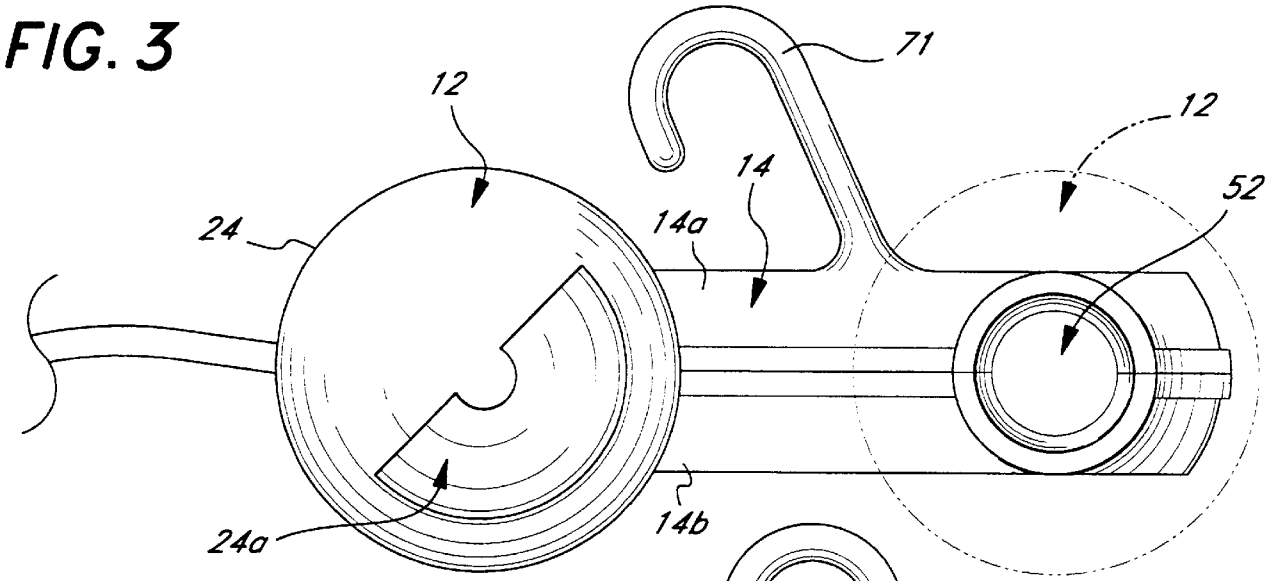
FIG. 3 is a front elevational view showing one pair of decorative lights with one of the lamps removed for clarity.

As best shown in FIGS. 1 and 2, the string of decorative lights 10 of this invention comprise pairs of lamps 12 mounted on a rigid support member 14. These pairs of lamps 12 are connected by a conductive line 16 that at one end 16*a* has a male plug 18 to be inserted into a conventional AC outlet (not shown) and at the other end 16*b* a female connector 20 that allows another string of lights to be attached to the string shown.

Figure 5A:
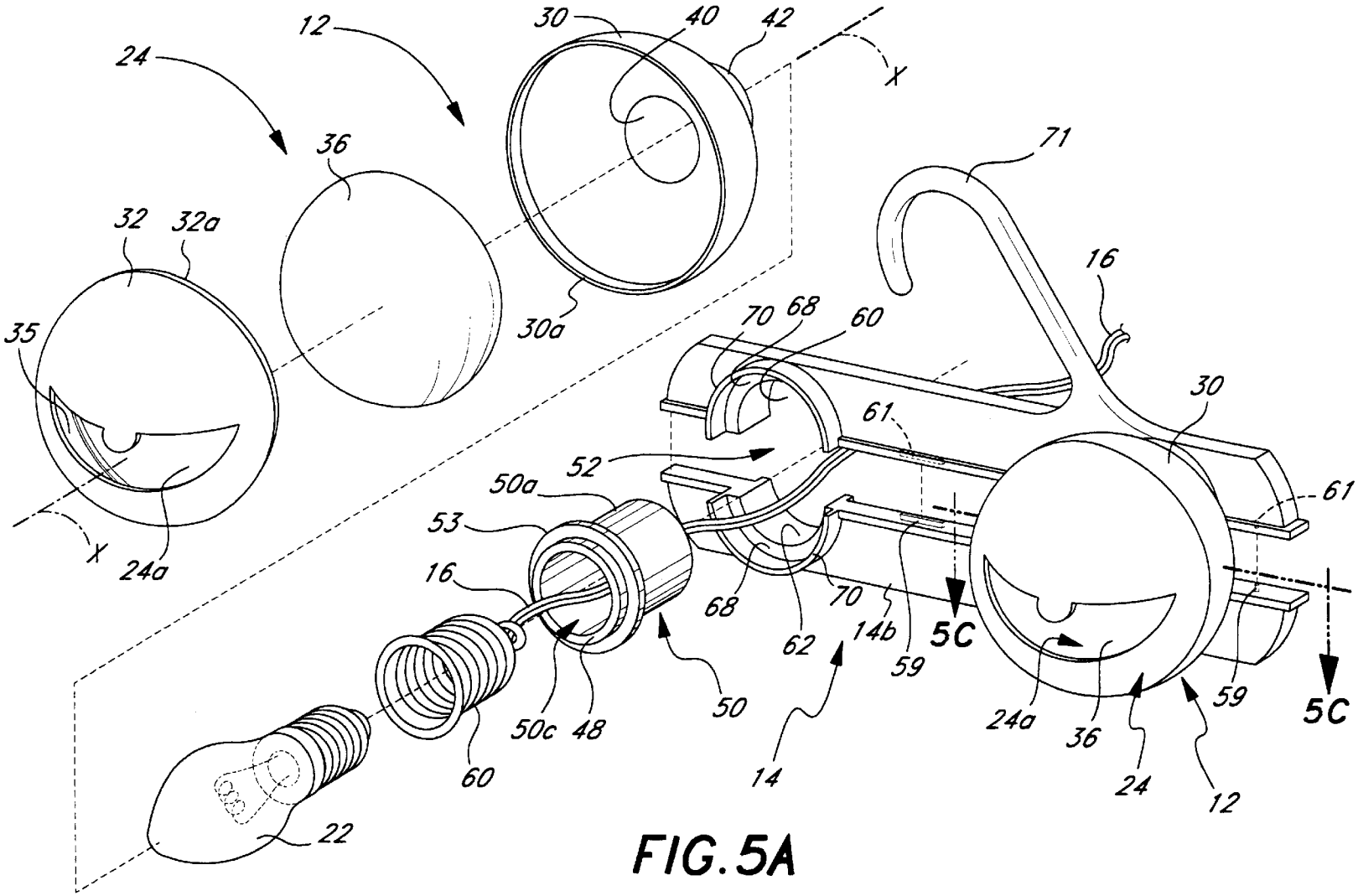
FIG. 5A is an exploded perspective view of one pair of decorative lights of this invention.
Figure 5B:
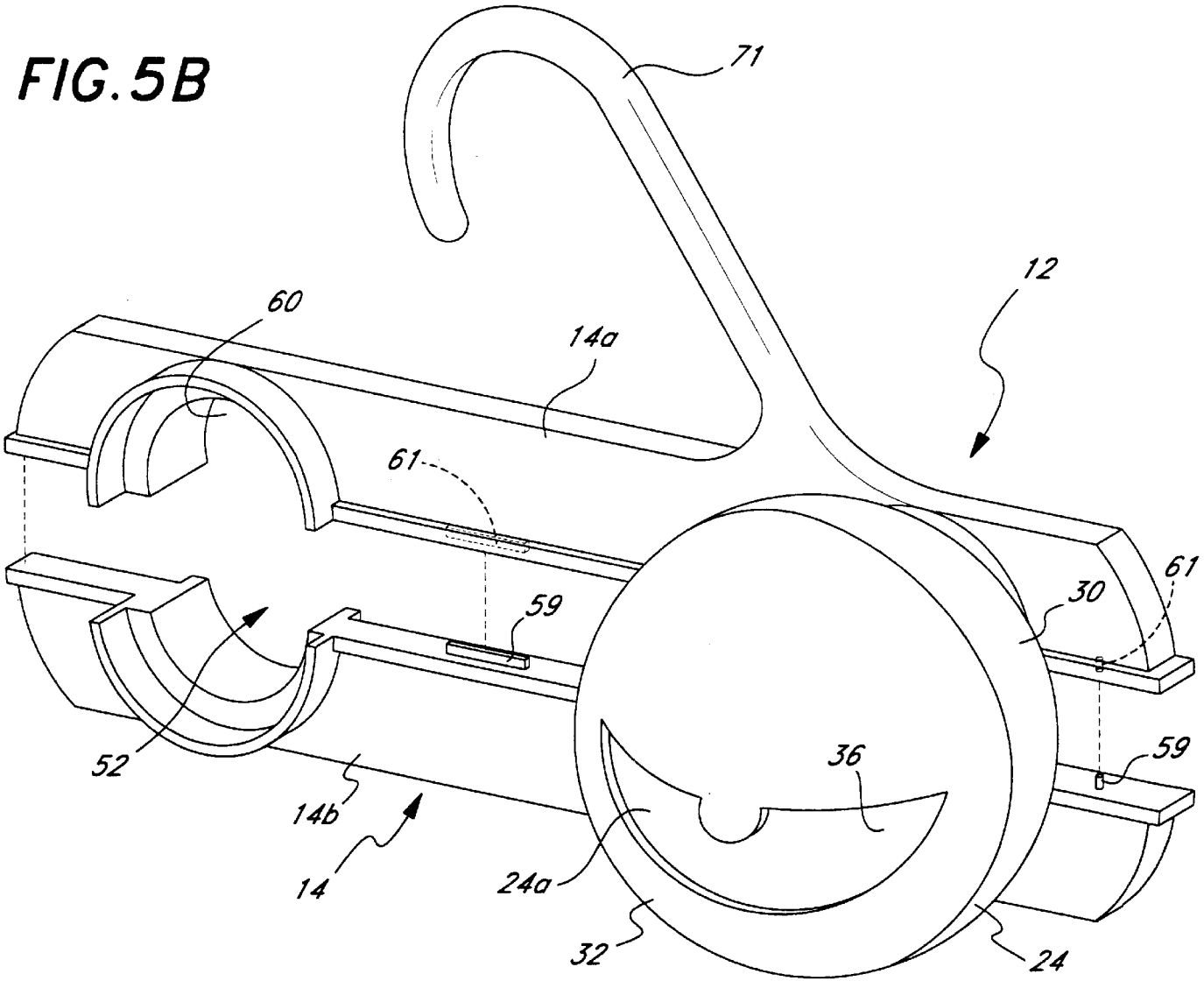
FIG. 5B is a perspective view showing the assembly of the support member for the decorative lights of this invention.
Figure 6:
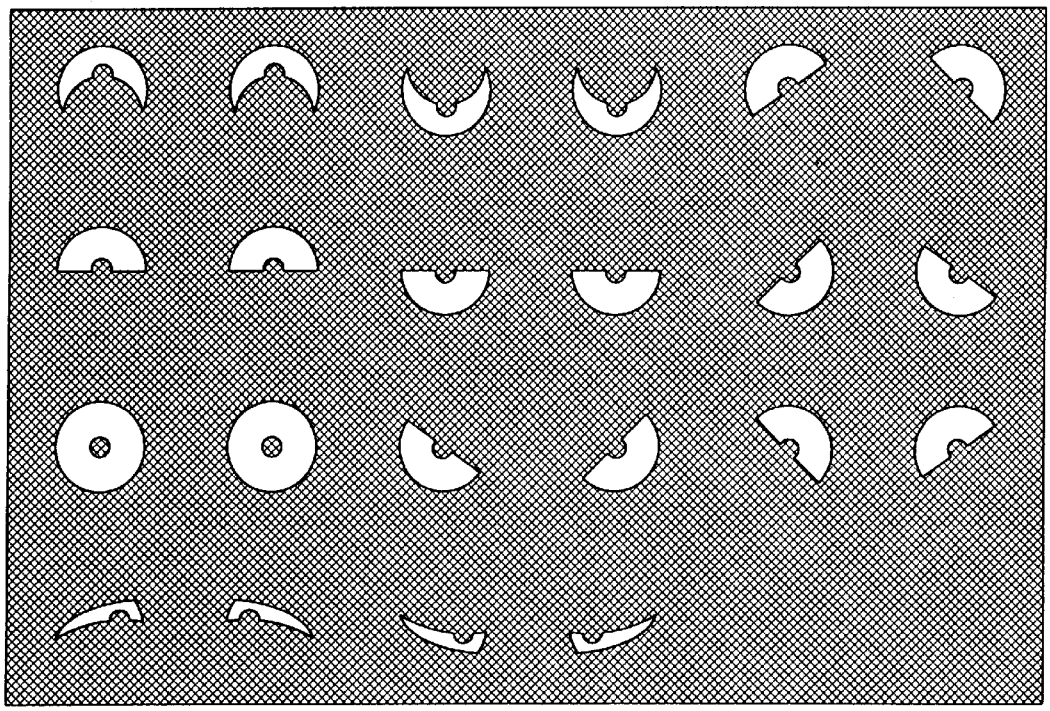
FIG. 6 is a silhouette drawing showing different outline shapes of pairs of illuminated eyes to be used in connection with this invention.
Figure 7:
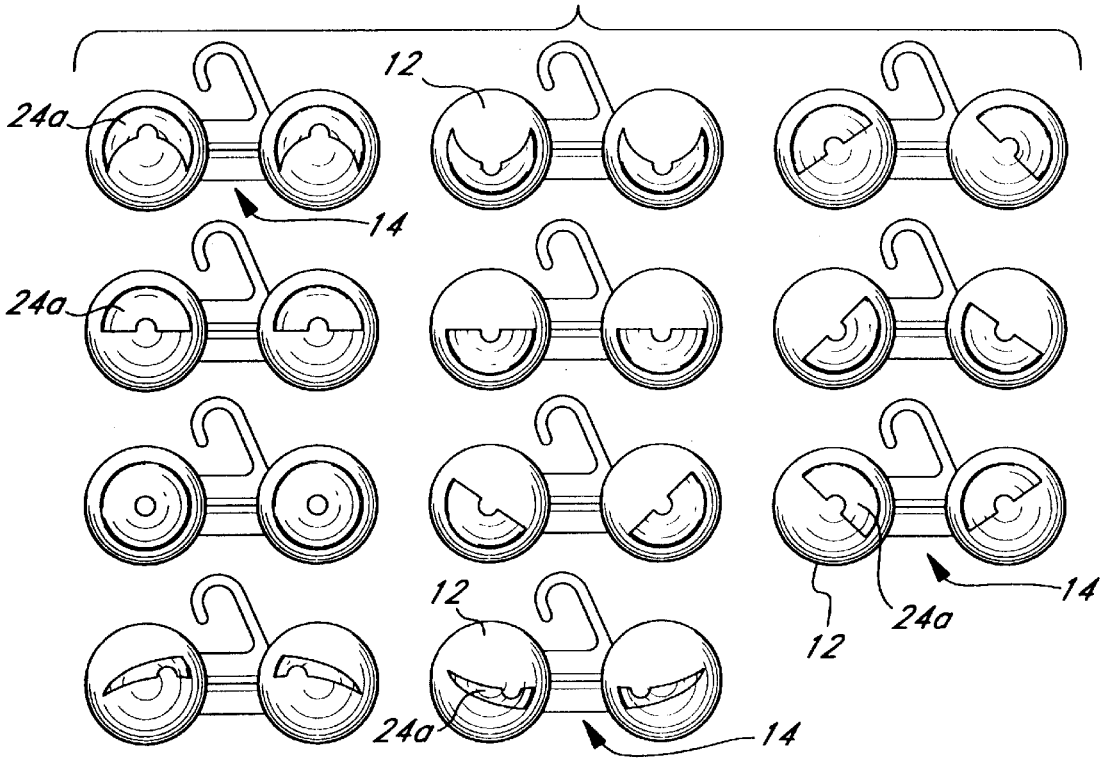
FIG. 7 is an illustration of the different-shaped eyes used with the decorative lights of this invention.

As best shown in FIG. 5A, each lamp 12 includes a light bulb 22 housed within an individual enclosure 24. There are two identical enclosures 24 mounted on each support member 14. Each pair of enclosures has a cutaway section 24*a* formed to simulate an open eye. As shown in FIGS. 6 and 7, a wide variety of eye outlines may be used. The string of lights 10 may include eye shapes that are all identical, or preferably as depicted in FIG. 2, each pair of lamps 12 mounted to an individual support 14 has identical eye outlines, but along the string from one support member to the next the eye shapes of the lamps 12 are different.

Strings of decorative lights 10 may be deployed either indoors or outdoors as shown in FIG. 1. When the light bulbs 22 are energized, light emanates from the cutaway section 24*a*. Thus someone walking by the house 26 shown in FIG. 1, will get the impression that the eyes of some unseen life forms lurking along the eves of the roof, looking from the windows, and hiding in the bushes and trees, are peering from the darkness following their every move. As depicted in FIG. 1, a motion sensor 11 may be connected to the decorative lights 10 to turn the lights on in response to motion. Thus, when someone approaches the house 26, the string of decorative lights 10 is turned on. When outside the range of the motion detector 11, the string of decorative lights 10 is turned off. A suitable motion detector may be purchased from Sentrol, Inc. of Tualatin, Oreg.

As best shown in FIG. 5A, each enclosure 24 comprises an inner hemispherical shell 30 and an outer hemispherical shell 32. Both the inner shell 30 and outer shell 32 have approximately equal diameters. Shell diameter typically is of from about 1 to about 4 inches. These shells 30 and 32 are made of an opaque material. Consequently, light only escapes from the enclosure 24 through the cutaway section 24*a*. Preferably, they are made from a plastic material such as, for example, polystyrene and ABS that is injected molded to form the shells. The shells 30 and 32 have their respective rims 30*a* and 32*a* interconnected. For example, the rims 30*a* and 32*a* may be connected by a conventional snap or force-fit type connection or the rims may be threaded. This allows these shells 30 and 32 to be manually separated to replace burned out light bulbs 22. Preferably, a light transmitting, preferably translucent, hemispherical member 36 is seated within the enclosure 24. This light transmitting hemispherical member 36 has a diameter slightly smaller than the diameter of the outer shell 32, so that it fits snugly against the inside wall 35 of the outer shell 32. In some lamps 12*a* (FIG. 2), a small diameter circular piece 36*a* is glued or otherwise bonded to the exterior surface of the light transmitting hemispherical member 36 to simulate the pupil of an eye.

Optionally, the enclosure 24 may also be a unitary structure made by conventional blow molding techniques. In this instance, the exterior of the enclosure would be painted to form an opaque layer with clear or translucent unpainted portions corresponding to the shape of an eye.

Figure 4:
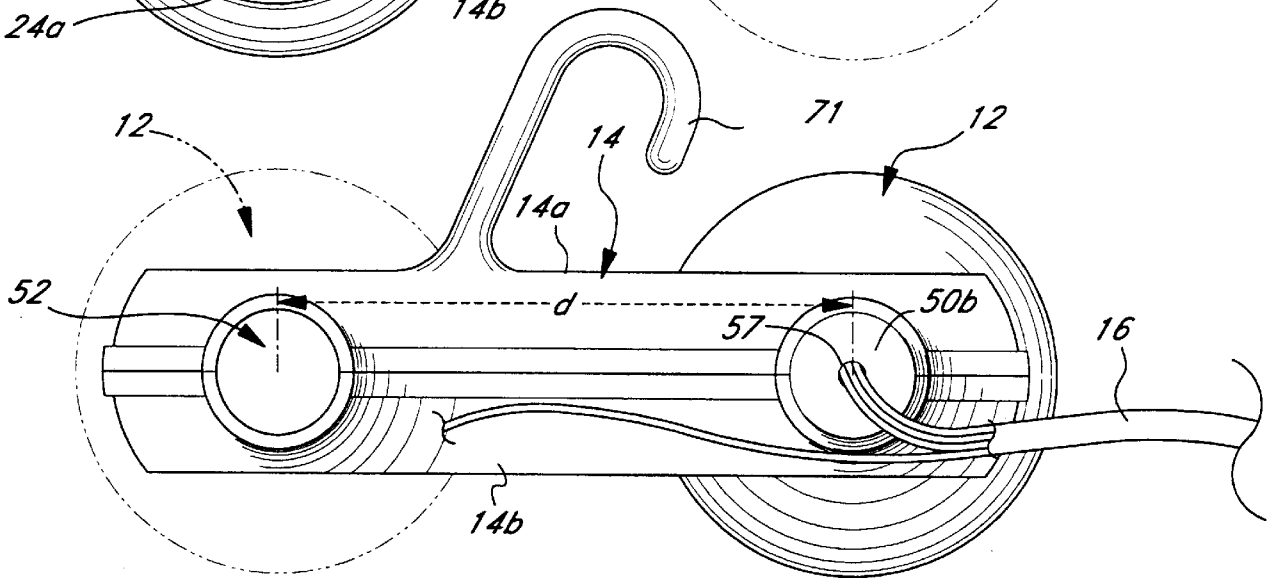
FIG. 4 is a rear elevational view of the pair of decorative lights shown in FIG. 3.

The inner shell 30 is removably attached to the rigid support member 14. This support member 14 may be a unitary structure as disclosed in U.S. provisional patent application Serial No. 60/104,055, or it may be divided into two sections: an upper section 14*a* and a lower section 14*b*. These sections 14*a* and 14*b* serve to grip the individual lamps 12 attached to an individual support 14. Along the central axis x of the inner shell 30 is an opening 40 with a flange 42 extending outward from this opening. This flange 42 fits over an annular lip 48 that extends outward from a socket case 50 held by the support member 14. The socket case 50 has a hollow cylindrical body 50*a* with an open mouth 50*c* and a closed bottom 50*b* having a hole 57 (FIG. 4) therein through which passes the conductive line 16. An annular collar 53 at the open mouth 50*c* inward of the lip 48 acts as a stop as the socket case 50 is inserted into a receptacle 52 in the support member. There are two receptacles 52 in each support member 14 and they are spaced apart a distance d (FIG. 4) that is about 4 inches. The support member 14 could be designed to enable its over all length to be varied, to enable this distance d to be adjusted as desired. There are male elements 59 that extend from the upper edge of the lower section 14*b* that mate with slots 61 in the upper section 14*a* upon engagement of these sections. The upper section also includes a hook 71 that facilitates attaching the pairs of lamps 12 to bushes, trees, or other support members.

Each socket case 50 for each lamp 12 is received within one of the two receptacles 52 formed when the edges of the two sections 14*a* and 14*b* are brought into contact with each other. The diameters of the receptacle 52 and each socket case 50 which fits snugly therein are such that there is a substantially water tight seal. The upper section 14*a* and lower section 14*b* each have a pair of semicircular cutouts 60 and 62 that, when the sections are brought into engagement, are aligned to form the pair receptacles 52 in each support member 14. Each cutout 60 and 62 has an inner land 68 that is surrounded by a semicircular wall 70. For each lamp 12, the socket case 50 holds a socket 60 into which a bulb 22 is screwed into place. The socket case for each lamp 12 is inserted into one of the receptacles 52. Upon assembly, the collar 53 of the socket case 50 bears against the lands 70, creating a gap 73 (FIG. 5C) between the wall 70 and the lip 48. The flange 42 of the shell 30 fits snugly with this gap 73, providing a watertight seal.

Figure 5C:
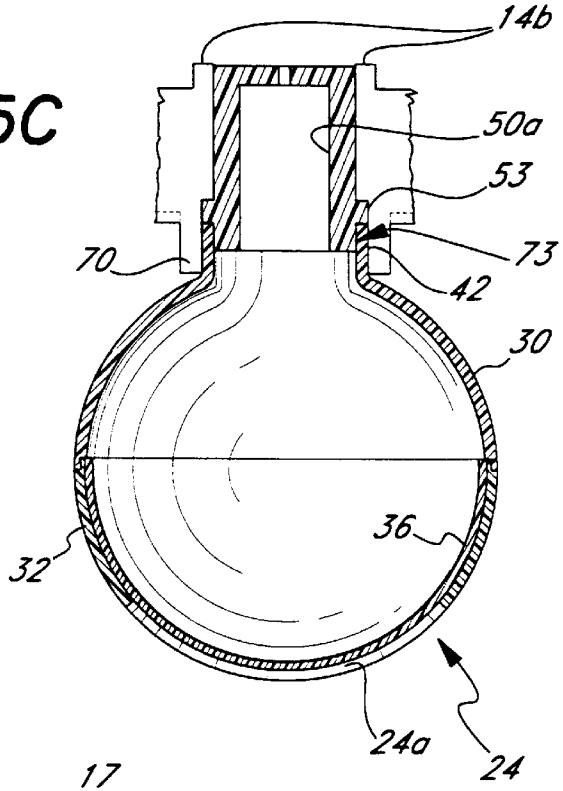
FIG. 5C is a cross-sectional view taken along line 5C—5C of FIG. 5A.
Figure 5D:
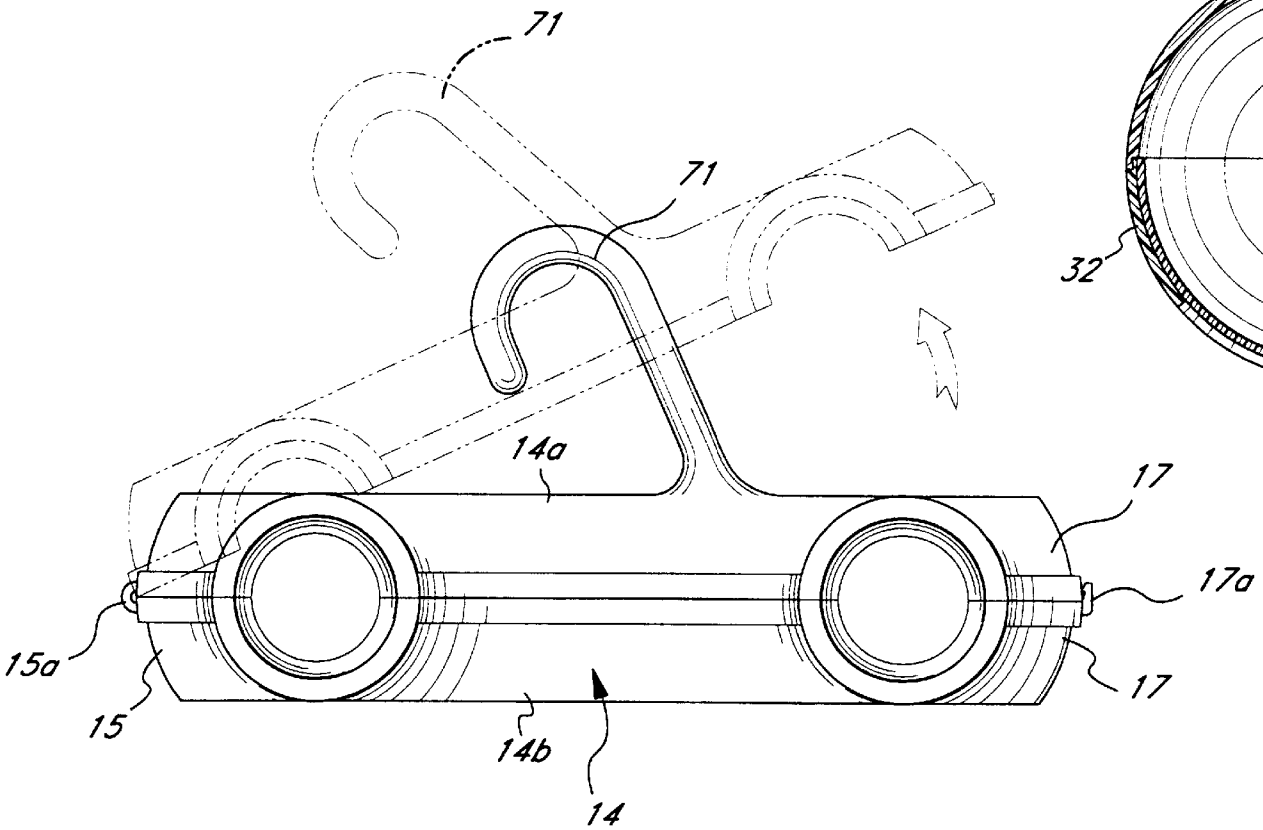
FIG. 5D is an alternate embodiment of this invention showing a hinge-type support member.

As shown in FIG. 5D, in an alternate embodiment, the two sections 14*a* and 14*b* have their ends 15 connected by a hinge 15*a*. Their opposite ends 17 have a clasp 17*a*. This structure enables the two sections 14*a* and 14*b* to be opened and closed, but not totally disconnected.

As shown in FIGS. 6 and 7, the cutaway section 24*a* of the outer shell 32 may have a number of different eye shapes. Furthermore as shown in FIG. 7, upon assembly, the outer shells 32 of each pair of lamps 12 on an individual support 14 may be rotated to enable the pair of eye cutaway sections 24*a* to be positioned in different orientations relative to each other.

Figure 8:
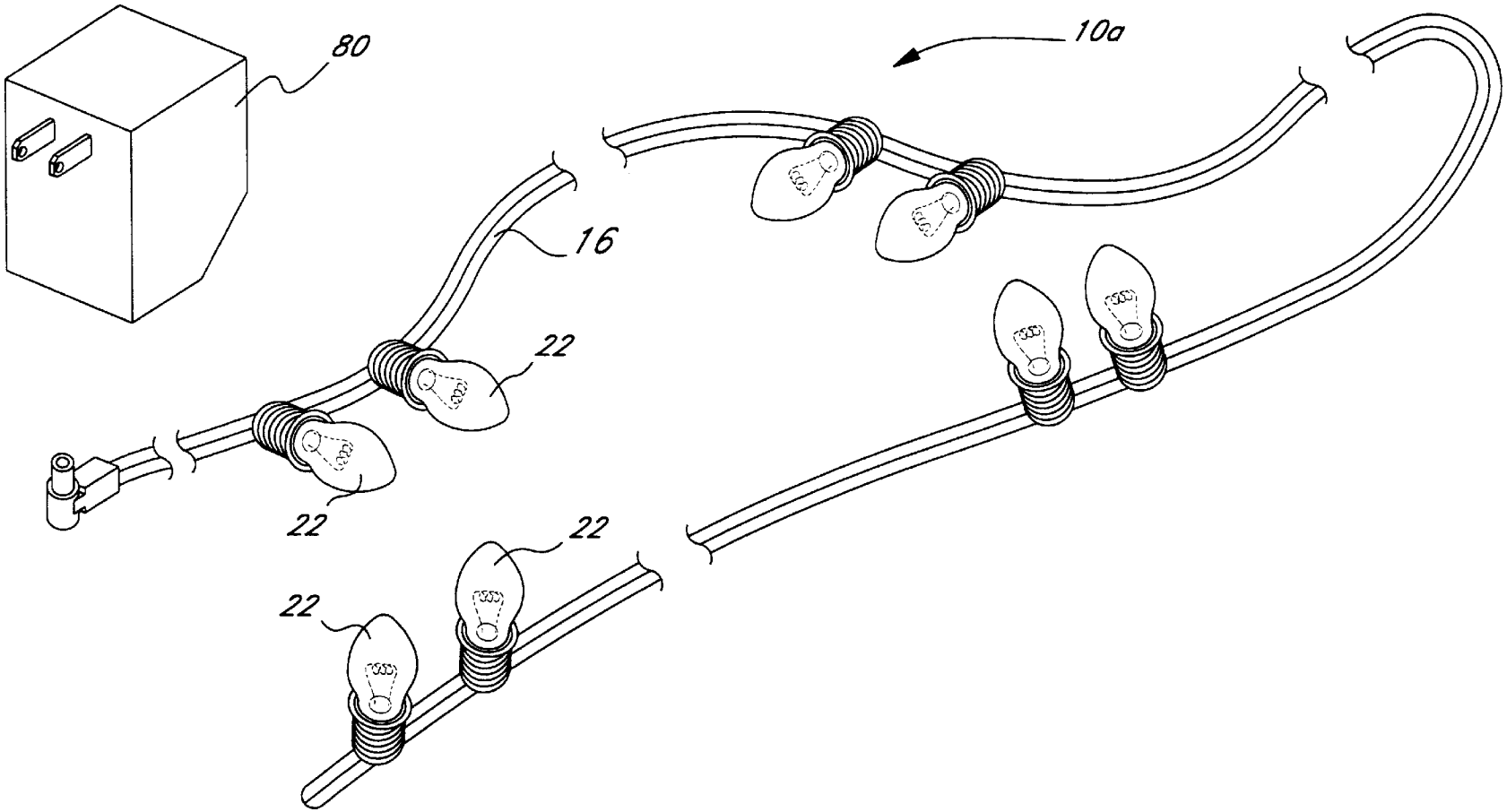
FIG. 8 shows pairs of light bulbs (enclosures and support members removed) in a string of decorative lights of this invention that are adapted to be connected to a transformer that converts AC power to DC power.
Figure 9:
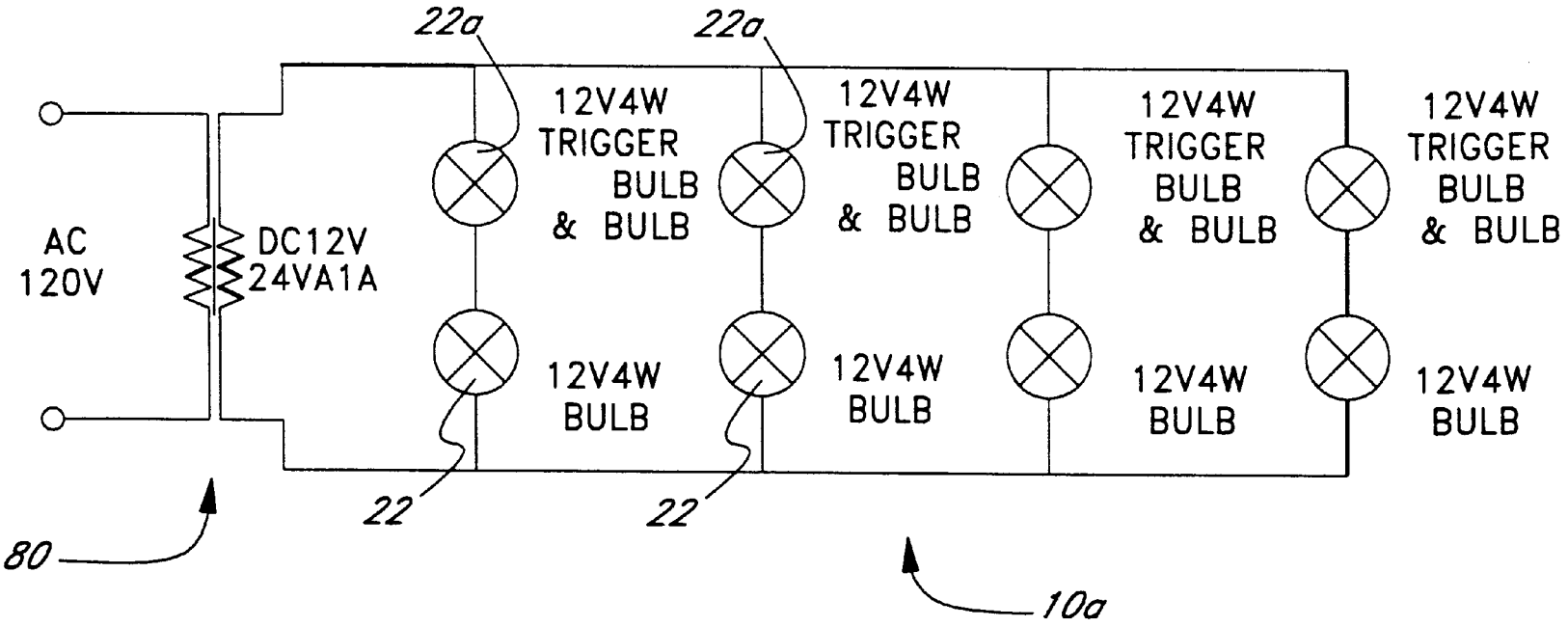
FIG. 9 is a schematic wiring diagram for the string of lights shown in FIG. 8.

As illustrated in FIGS. 8 and 9, a string of lights 10*a* includes pairs of lamps 12 connected to individual supports, and these pairs are in series and the different pairs are connected in parallel. As depicted in FIGS. 8 and 9, an adapter 80 is used to convert AC current to DC current These lamps 12 may include a switch for turning some lamps 12 on and some lamps off intermittently to enhance further the decorative effect of the string of lights 10. This preferably is accomplished using conventional trigger bulbs 22*a*. Such trigger bulbs 22*a* include a bimetallic element (not shown) near the filament of the trigger bulb 22*a* that deflects as it is heated by the filament. At a certain temperature the deflection of the bimetallic element breaks the circuit, shutting off the lights 10. Upon cooling, the bimetallic element returns to its normal position to again turn on the lights 10.

Figures 10, 11:
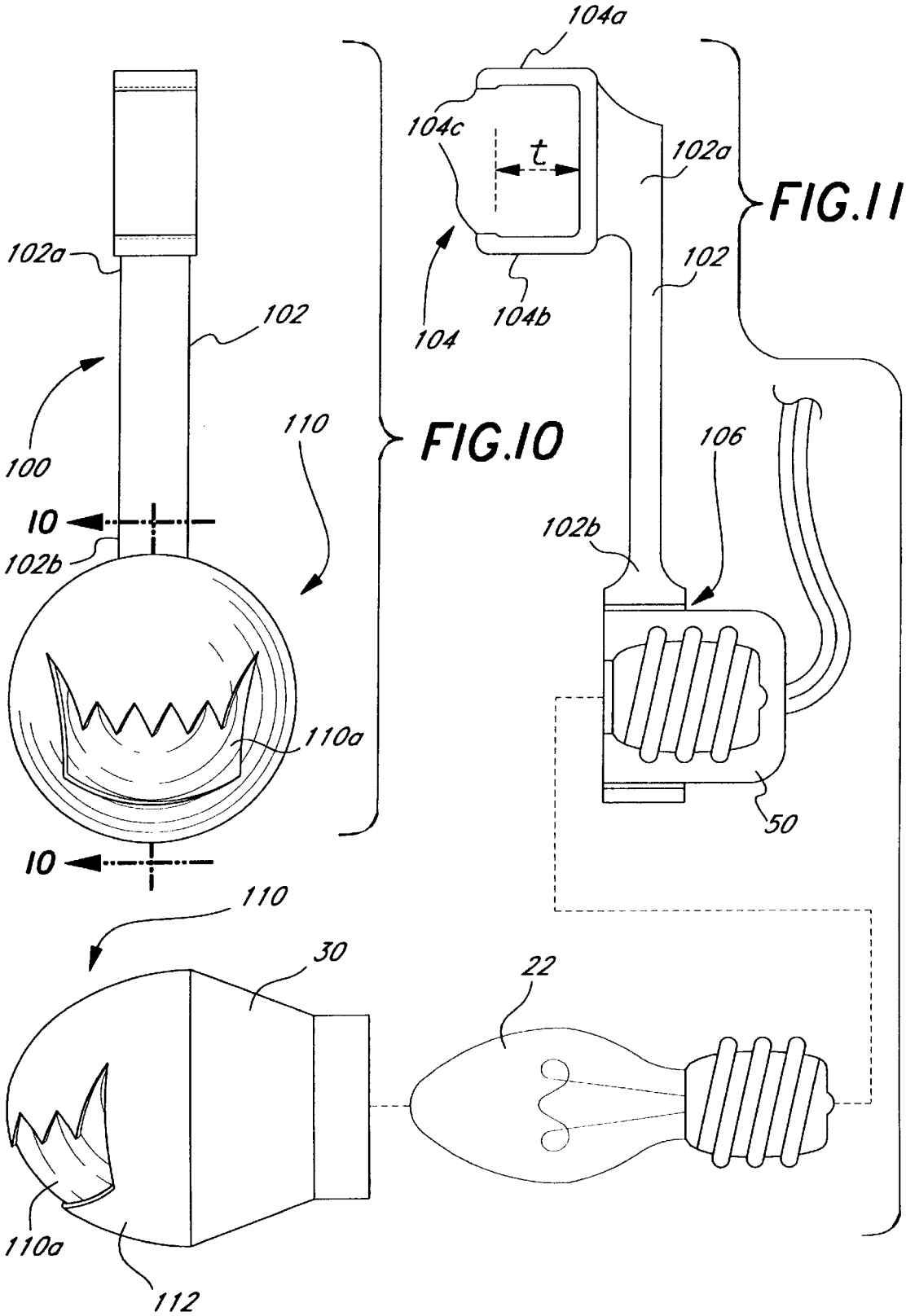
FIG. 10 is a front elevational view of a mouthpiece adapted to be attached to one pair of the decorative lights shown in FIG. 3.
FIG. 11 is a side view of the mouthpiece shown in FIG. 10 with portions shown as exploded.
Figure 12:
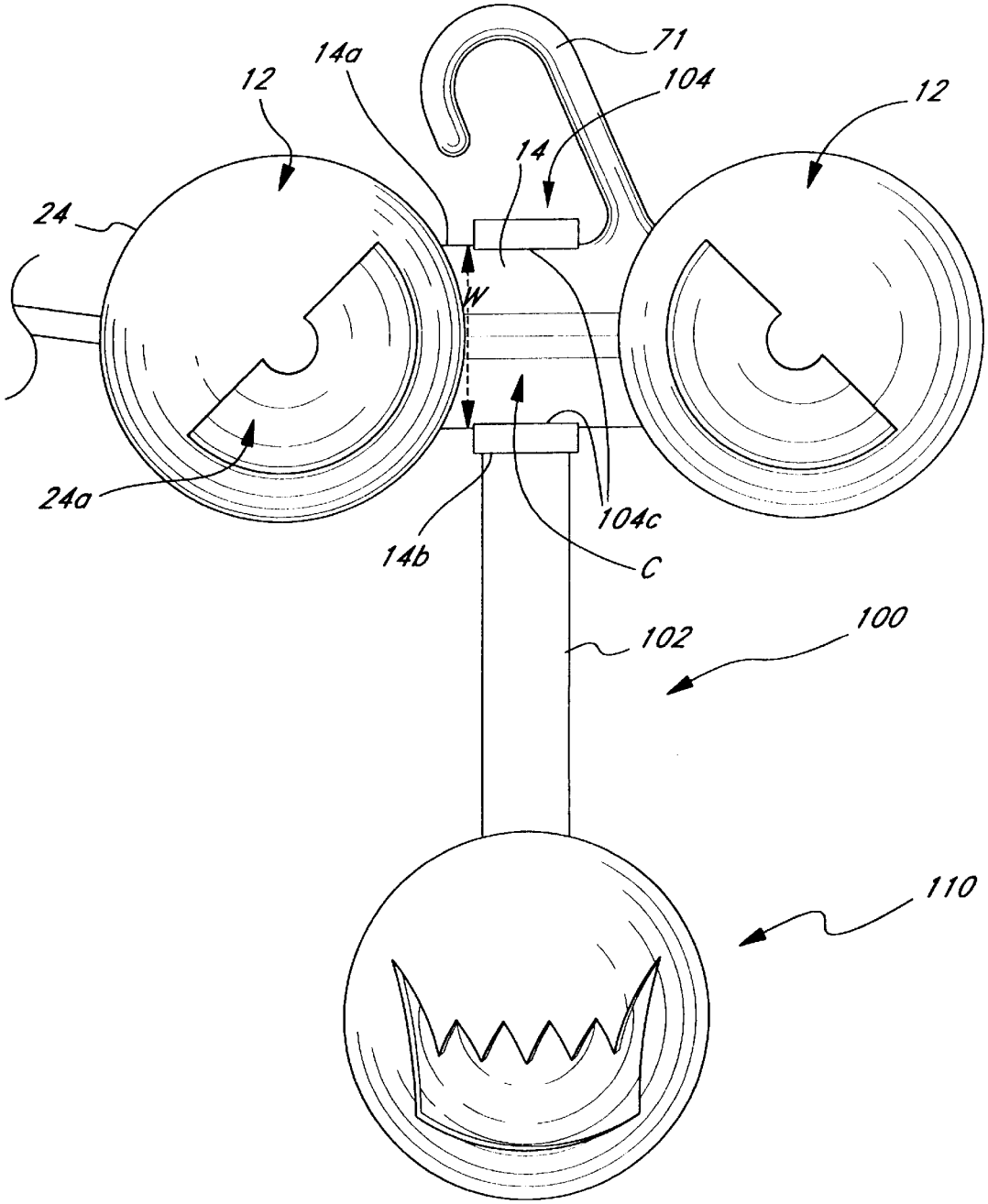
FIG. 12 is a front elevational view of the mouthpiece shown in FIG. 10 attached to the pair of the decorative lights shown in FIG. 3.

As illustrated in FIGS. 10 through 12, a mouthpiece member 100 may be attached to an individual support 14. This mouthpiece member 100 includes a rigid arm 102 having at one end 102*a* a clip 104 that snaps over the central portion C of the individual support 14 as shown in FIG. 12. This clip 104 has a pair of lips 104*a* and 104*b* that a space apart a distance about equal to the width w of the central portion C of the individual support 14 and have a length about equal to the thickness t of the support. These lips 104*a* and 104*b* are resilient and flex to separate slightly as the clip 104 is forced over the central portion C of the individual support 14. They then return to their normal, unflexed position when their tips 104*c* pass the outside edges 14*d* of the support 14. Thus, the central portion C of the individual support 14 is firmly grasped by the clip, which may be detached if desired.

Figure 13:
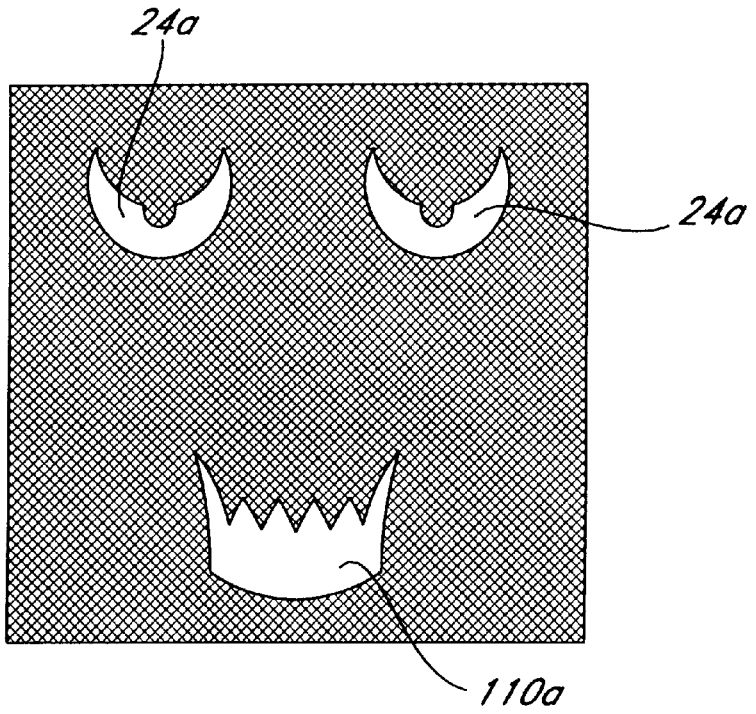
FIG. 13 is a silhouette drawing showing the combination of an illuminated pairs of eyes and illuminated open mouth provided by the mouthpiece shown in FIG. 10.
Figure 14:
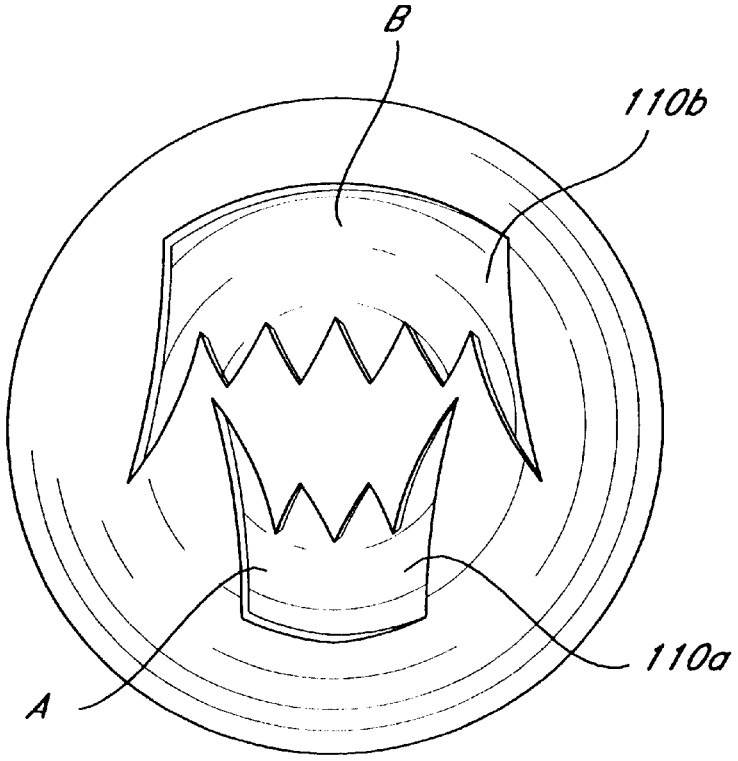
FIG. 14 is a silhouette drawing an alternate shape for the open mouth of the mouthpiece shown in FIG. 10.

At the other end 102*b* of the arm 102 is a socket assembly 106 that is essentially the same as that shown in FIG. 5C. This socket assembly 106 has a socket case 50 with a socket 60 that holds a light bulb 22. An enclosure 110 is connected to the socket assembly 106 in essentially the same as the enclosure 24 is connected to the socket case 50 as shown in FIG. 5A. The enclosure 110 comprises an inner hemispherical shell 30 and an outer hemispherical shell 112. The outer shell 112 is, except for a cutaway section 110*a*, essentially the same as the shell 32. The cutaway section 110*a* is arranged to resemble an open mouth. Thus, with the mouthpiece member 100 attached to the individual support 14, the decorative lights of this invention provide illuminated, open eyes and an illuminated, open mouth with teeth showing as depicted in FIG. 13. FIG. 14 shows an alternate embodiment of the shell 112 where there is a second cutaway section 110*b* above the first cutaway section 110*a*. In this embodiment there are two rows A and B of teeth adjacent each other and overlying adjacent each other.

Figure 15:
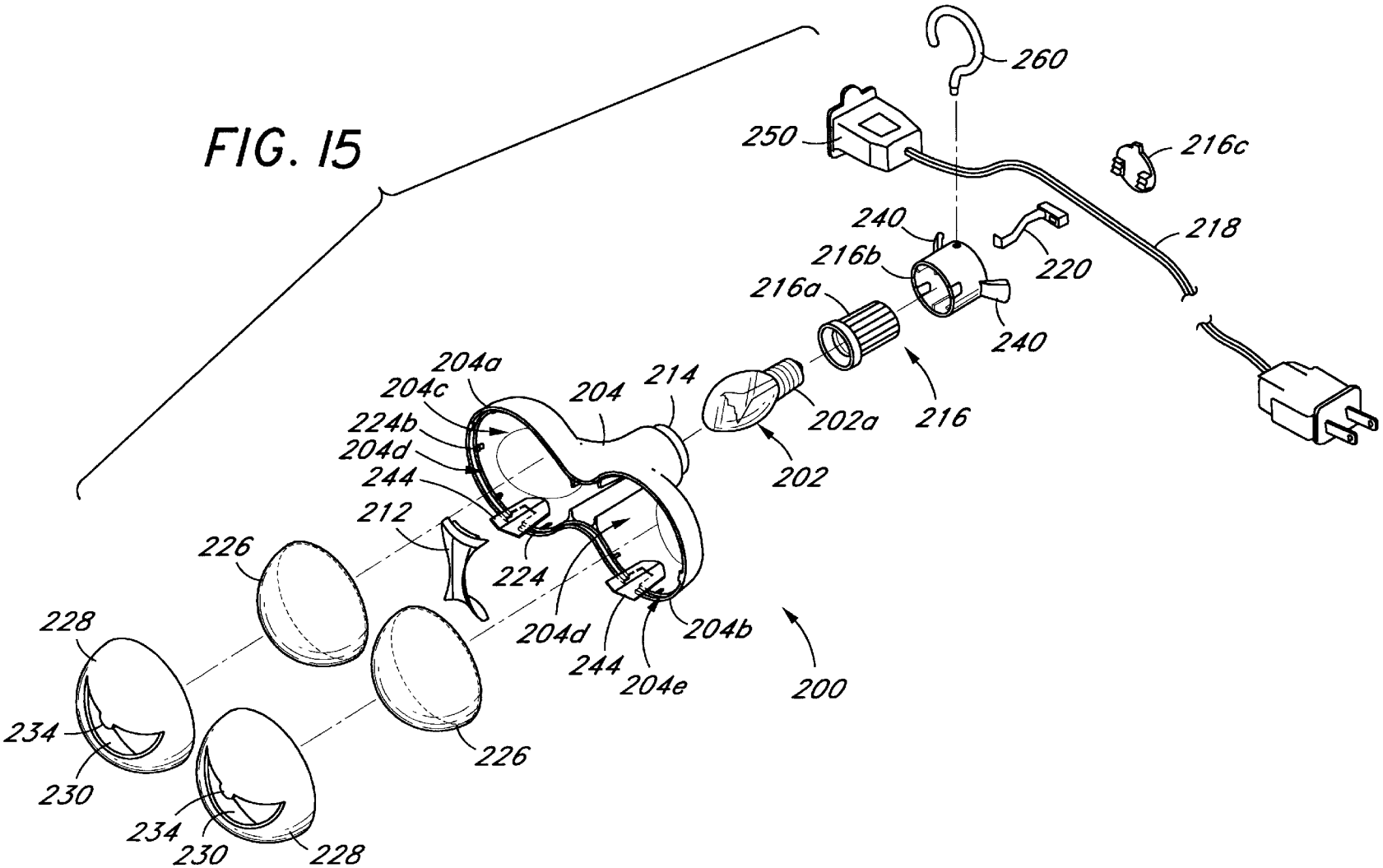
FIG. 15 is an exploded perspective view of another alternate embodiment of the decorative light of this invention.
Figure 16:
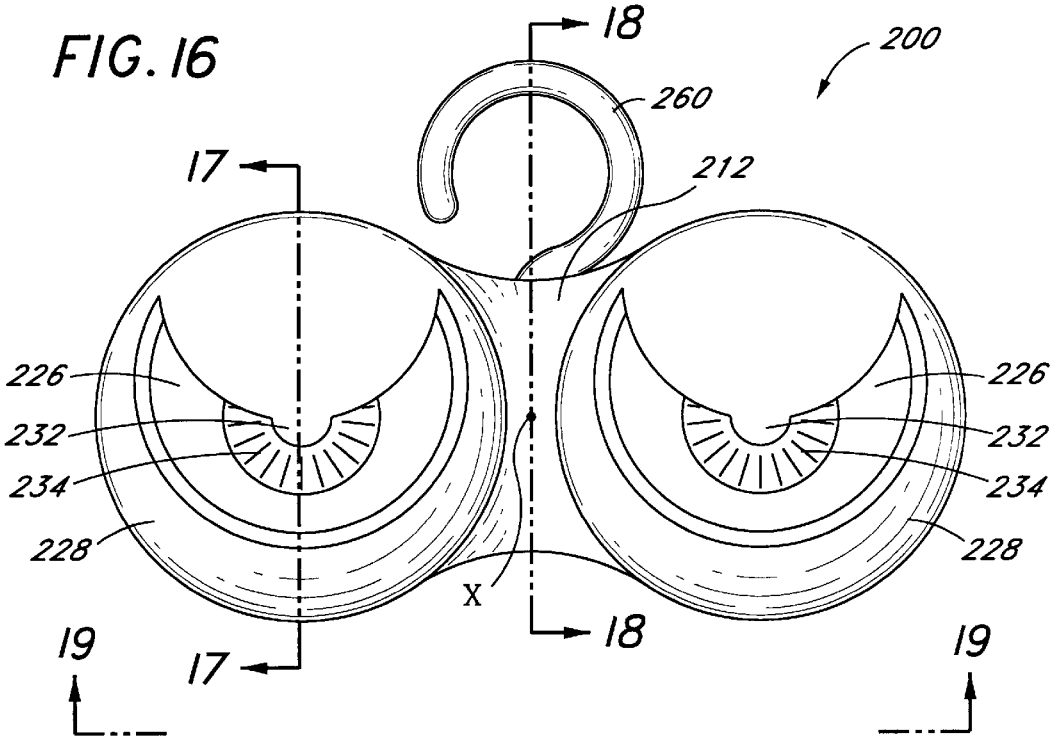
FIG. 16 is a front elevational view of the decorative light of this invention shown in FIG. 15.

FIG. 15 shows another alternate embodiment of this invention, the decorative light 200, employing only a single light bulb 202, preferably a flashing light bulb, which has a voltage of 120 volts and a power rating of 5–watts. The light bulb 202 is a conventional "Christmas" tree-type light that is commonly used in the United States.

In this embodiment, the decorative light 200 has a housing 204 with two sections 204*a* and 204*b*, each having a hollow interior 204*c* and 204*d*. The rear walls 206*a* and 206*b* respectively of each section 204*a* and 204*b* each have an internal, substantially flat, polished surface 210 (FIG. 17) that is light reflective. These polished surfaces 210 face inwardly towards each other and are at an angle of approximately 20 to 40 degrees with respect to the central axis X of the housing 204. The housing 204 includes a heat shield 222 which has an upper element 222*a* and lower element 222*b* respectively positioned above and below the light bulb 202. These elements 222*a* and 222*b* partially surround the light bulb 202. They are made of an insulating plastic material and are integral and molded with the housing 204.

It has been found that the interiors 204*c* and 204*d* of the housing 204 may collect water. Consequently, it is desirable to provide for drainage. Along the front lower edge of each section 204*a* and 204*b* of the housing 204 is an indentation 242, which provides a drain orifice to allow any liquid collected within an interior 204*d* or 204*e* of the housing 204 to drain from the housing. A baffle member 244 that is integral with the housing 204 extends over the indentation 242 (drain orifice) to prevent any significant amount of light from escaping through the drain orifice.

The rear walls 206*a* and 206*b* merge at a central rear opening 214 in the housing 204. The central axis X intersects the center of this opening 214. This central opening 214 has a removable socket 216 forced fitted into it. The socket 216 includes an inner cylindrical case 216*a* and outer cylindrical case 216*b*. These cases 216*a* and 216*b* are nested together, each having open ends. A base 216*c* closes off the outer rear ends of the nested together cases 216*a* and 216*b*. A power cord 218 extends between the base 216*c* and the rear ends of the cases 216*a* and 216*b*. A metal connector 220 has one portion that pierces this power cord 218 and another portion that makes contact with the threaded end 202*a* of the light bulb 202 when the bulb has been screwed into the socket 216. The socket 216 has a pair of tabs 240 extending outwardly from it that assist in gripping the socket so that it may be pulled from the central rear opening 214. A hook 260 is mounted to the portion of the outer cylindrical case 216*b* of the socket 216 extending from the rear opening so that it may b e rotated.

Figure 17:
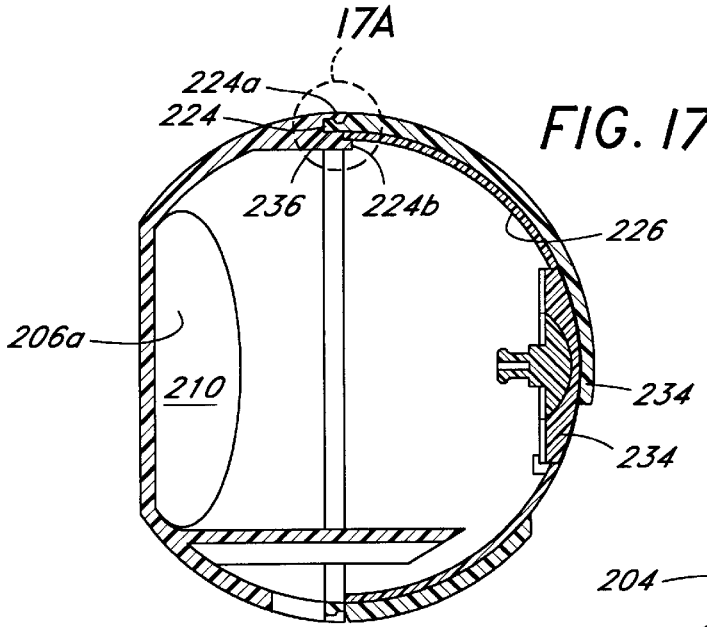
FIG. 17 is a cross-sectional view taken along line 17—17 of FIG. 16.
Figure 17A:
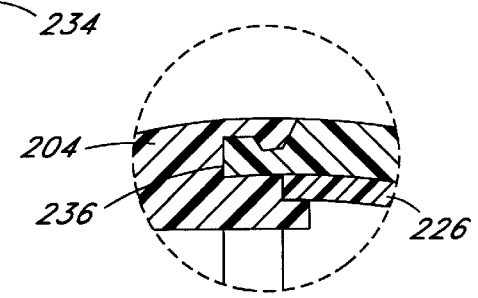
FIG. 17A is a cross-sectional, fragmentary view taken along line 17A of FIG. 17.
Figure 18:
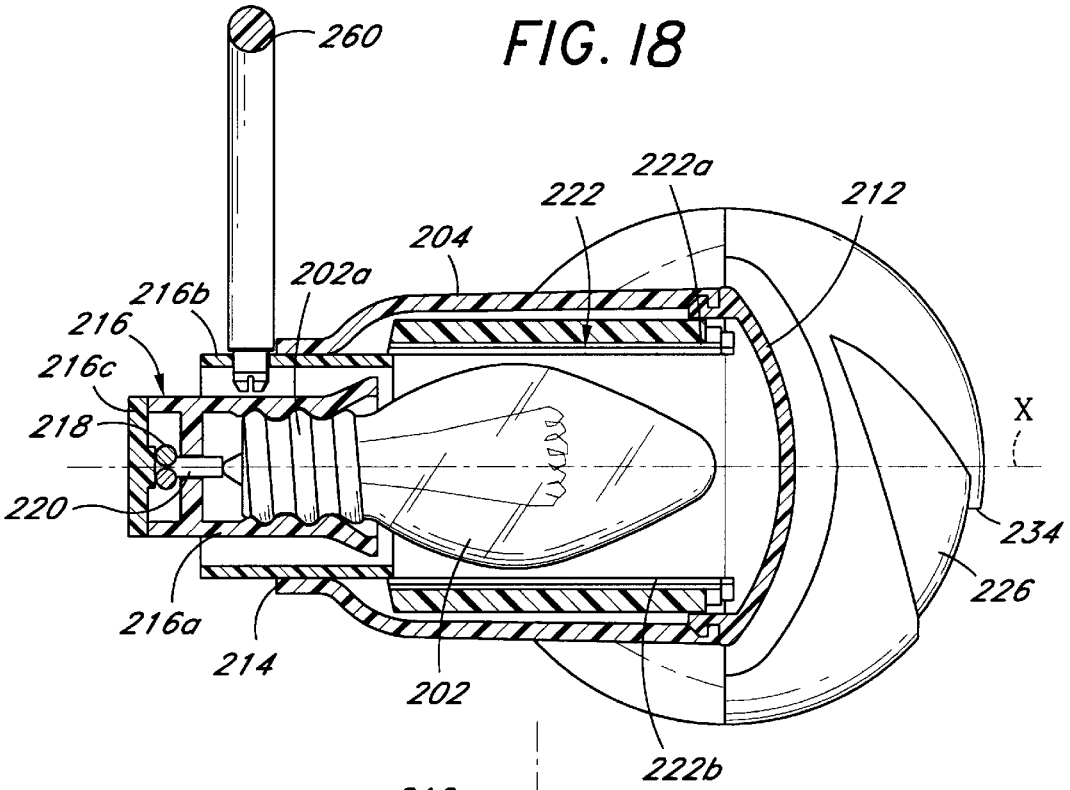
FIG. 18 is a cross-sectional view taken along line 18—18 of FIG. 16.
Figure 19:
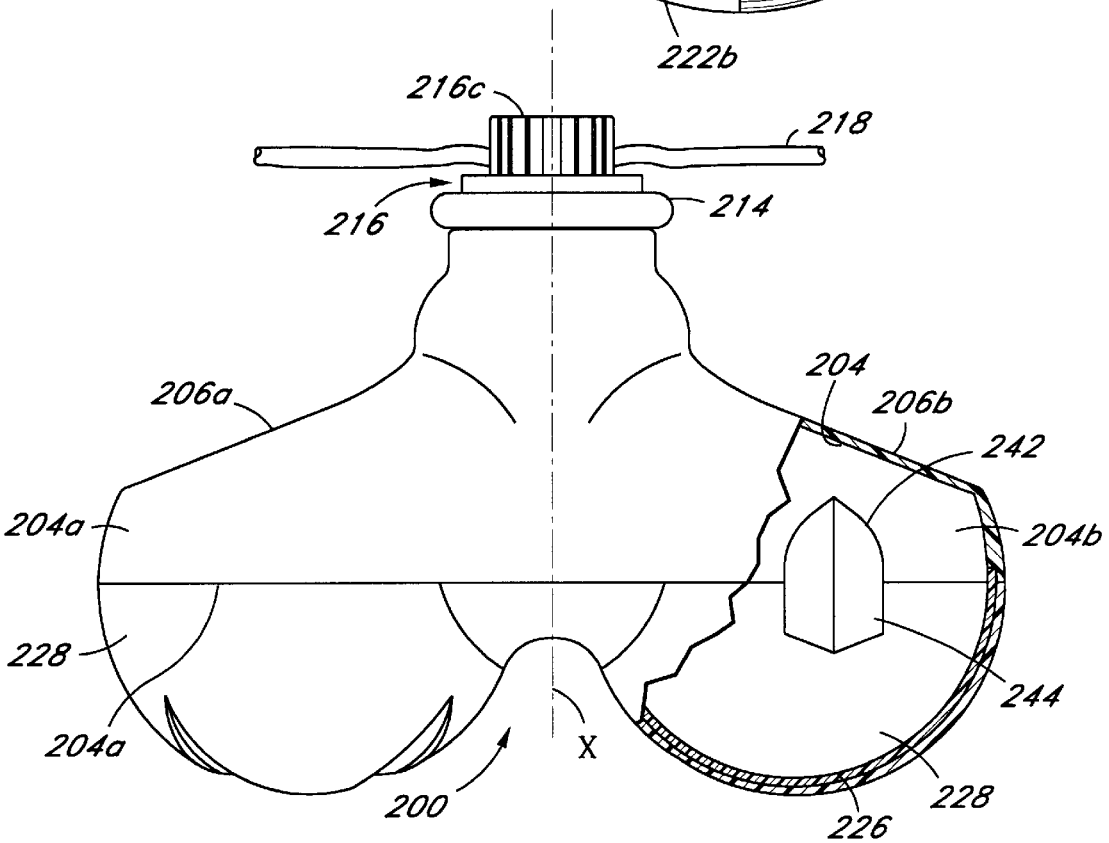
FIG. 19 is a plan view, with sections broken away, of the underside of the decorative light taken along line 19—19 of FIG. 16.

The sections 204*a* and 204*b* of the housing 204 are separated by a link member 212, which is aligned with the central axis X (FIG. 19) of the housing 204. The link member 212 may be glued or molded into the housing 204. On each side of the link member 212 is a front opening 204*d* and 204*e* respectively in the housing 204. The front openings 204*d* and 204*e* each have a partially circular ledge 224 with an outer lip 224*a* (FIGS. 17 and 17A). Adjacent the underside of these ledges 224 along their perimeters are a number of spaced apart finger members 224*b*.

A translucent hemispherical member 226 is nested on the inside of a hemispherical shell 228. The hemispherical shell 228 has a cut away section 230 in the form of an eye. The translucent hemispherical member 226 has a centrally located circular piece 232 corresponding to the iris of an eye and the border of the cut away section has a semi-circular section 234 corresponding to the pupil of an eye which is centrally positioned with respect to the circular piece 232 corresponding to the iris.

An assembly of the nested together translucent hemispherical member 226 and hemispherical shell 228 is pushed into each of the front openings 204*d* and 204*e*. As best shown in FIG. 17A, each edge 236 of these assemblies snaps into position, each edge resting on the ledge 224 of one of the front opening with each edge being gripped between the finger members 224*b* and the outer lip 224*a*. Each assembly of the nested together translucent hemispherical member 226 and hemispherical shell 228 may be manually rotated while it is mounted in a front opening in the housing 204. Consequently, it is possible to create a different eye expressions simply by turning these assemblies while they are attached to the housing 204.

Figure 20:
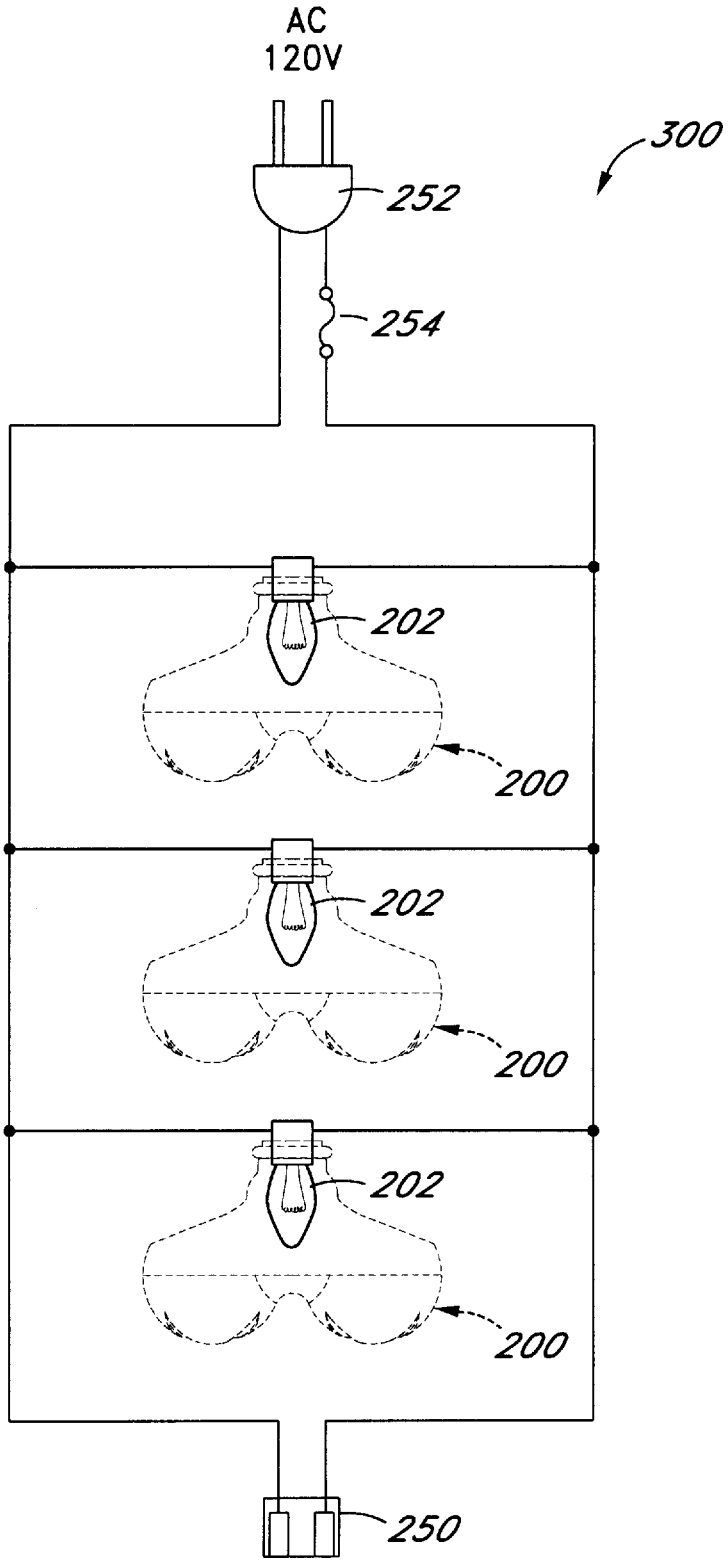
FIG. 20 is a schematic wiring diagram for a string of decorative lights shown in FIG. 15.

As depicted in FIG. 20, a number of the decorative lights 200 are connected together in a string 300 with the light bulbs 202 being connected in parallel. There is an outlet connector 250 at one end of the string 300, and at the opposite end is a plug 252 with a fuse 254. Consequently, several of these strings 300 of lights may be connected together.

Except for the light bulb 202, the cord 218, and the metal parts of the socket 216, all the components of the decorative light 200 are made of suitable plastics. These components are typically force fitted together.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. Decorative lights including a lamp attached to a conductive line adapted to be connected to a source of electrical power, said lamp comprising a pair of spaced apart eye members each having a hollow interior, said eye members each having a front with an opaque portion and a light transmitting portion arranged to resemble an open eye, said eye members being attached to a housing having a centrally positioned single light source therein that, when illuminated, transmits light through said light transmitting portions.

2. The decorative lights of claim 1 where the hollow interiors each have a reflective surface.

3. The decorative lights of claim 2 where the reflective surfaces are substantially flat and are facing inward towards each other.

4. The decorative lights of claim 1 including a heat shield that at least partially encloses said single light source.

5. The decorative lights of claim 1 where the light source is a flashing light bulb having a voltage of 120 volts and a power of 5 to 7 watts.

6. A plurality of decorative lights as defined in claim 1 where the light sources of said lights are flashing light bulbs connected in parallel and bulbs each have a voltage of 120 volts and a power of 5 to 7 watts.

7. Decorative lights including a plurality of lamps attached to a conductive line adapted to be connected to a source of electrical power, each lamp comprising a pair of spaced apart eye members each having a hollow interior with a reflective surface, said eye members each having an opaque portion and a light transmitting portion arranged to resemble an open eye, said eye members being attached to a housing having a single light source therein that illuminates the interior of the eye members.

8. A decorative light, including a housing having central axis with a rear central opening located along said central axis and a pair of spaced apart front openings on opposite sides of the central axis, each front opening being the same distance from the central axis and aligned with each other, a light source holder positioned in said rear central opening, an insert in each of the front opening, each insert having an opaque portion and a light transmitting portion, said opaque and light transmitting portions arranged to resemble an open eye.

9. The decorative light of claim 8 where each insert is a substantially hemispherical structure comprising first and second substantially hemispherical shells nested together so that the first shell is the inner shell and the second shell is the outer shell, the first hemispherical shell being at least partially transparent, and the second hemispherical shell having an open section in the form of an outline of an eye and a substantially entirely opaque remainder section.

10. The decorative light of claim 9 where the first hemispherical shell has a central colored portion that has a circular shaped simulating an iris of an eye.

11. The decorative light of claim 10 where second hemispherical shell has an opaque portion shaped to simulate a pupil of an eye overlying the central colored portion of the first hemispherical shell.

12. The decorative light of claim 9 the hemispherical shells are detachably connected together.

13. The decorative light of claim 9 where the hemispherical shells are mounted to rotate.

14. The decorative light of claim 8 where the housing has a hook element thereon mounted to rotate.

15. The decorative light of claim 8 where the shells and housing form a pair of spaced apart enclosures, each enclosure having a drain orifice therein.

16. The decorative light of claim 15 where there is a baffle member positioned to block light from escaping through the drain orifice.

17. A decorative light, including a housing having central axis with a rear central opening located along said central axis and a pair of spaced apart front openings on opposite sides of the central axis, each front opening being the same distance from the central axis and aligned with each other, a light source holder positioned in said rear central opening, an insert in each of the front openings, each insert having an opaque portion and a light transmitting portion, said opaque and light transmitting portions arranged to resemble an open eye, one insert comprising a first transparent, substantially hemispherical shell and the other insert comprising a second hemispherical shell having an open section in the form of an outline of an eye and a substantially entirely opaque remainder section, said first and second shells being nested together so that the first shell is the inner shell and the second shell is the outer shell, said shells and housing forming a pair of spaced apart enclosures, each enclosure having a drain orifice therein, and a baffle member positioned to block light from escaping through the drain orifice.

18. The decorative light of claim 17 where the first hemispherical shell has a central colored portion that has a circular shaped simulating an iris of an eye.

19. The decorative light of claim 18 where second hemispherical shell has a small opaque portion shaped to simulate a pupil of an eye overlying the central colored portion of the first hemispherical shell.

20. A decorative light including an enclosure having a rear portion holding a single light source and a front portion, said front portion having a pair of spaced apart members each with opaque and light transmitting portions arranged to resemble an open eye light, at least some of the light from said single light source escaping the enclosure through said light transmitting portions.

21. A method of decorating including (a) providing a conductive line having decorative lights connected thereto, each light comprising an enclosure having a rear portion holding a single light source and a front portion, said front portion having a pair of spaced apart members each with opaque and light transmitting portions arranged to resemble an open eye light, at least some of the light from said single light source escaping the enclosure through said light transmitting portions, (b) hanging the decorative lights on an item to be decorated, and (c) attaching the line to a source of electrical power.

* * * * *